US005793397A

United States Patent [19]

Barker et al.

[11] Patent Number: 5,793,397

[45] Date of Patent: Aug. 11, 1998

[54] PRINTER ASSEMBLY

[75] Inventors: Don Barker, Sandy Hook, Conn.; John Hamma, Isle of Palms, S.C.; John J. Mercede, Jr., Easton, Conn.; Mike Raymond, Bolton, Conn.; Norman L. Milliard, East Hartford, Conn.

[73] Assignee: Accent Color Sciences, Inc., East Hartford, Conn.

[21] Appl. No.: 552,798

[22] Filed: Nov. 3, 1995

[51] Int. Cl.[6] ..... B41J 2/175

[52] U.S. Cl. ..... 347/88

[58] Field of Search ..... 347/16, 88, 139, 347/149, 153, 220, 215, 216

[56] References Cited

U.S. PATENT DOCUMENTS 4,370,665 1/1983 Scranton et al. ..... 347/16

4,452,543 6/1984 Adkinsson et al. ..... 400/605

5,386,772 2/1995 Tolle et al. ..... 101/248

5,445,369 8/1995 Golicz et al. ..... 271/3.23

*Primary Examiner*—Edward Tso

*Attorney, Agent, or Firm*—Alix, Yale & Ristas, LLP

[57] ABSTRACT

A hybrid printing system adds color accents to documents produced by high speed black on white printers using wax based inks. The color indicia is printed while the moving documents are supported against a curved surface and the documents are heated to an appropriate temperature for use of a wax based ink between black printing and color accent printing.

53 Claims, 12 Drawing Sheets

PRINTER ASSEMBLY

BACKGROUND OF THE INVENTION

1. Field of the Invention

The present invention relates to the processing of printed documents and, particularly, to the addition of indicia comprising one or more colors to previously printed black on white documents. More specifically, this invention is directed to a document processing system having a single paper path and the capability of being interfaced with a high speed monocolor printer and, especially, to apparatus employing multiple print heads to add colored indicia to text or graphics on documents exiting the interfaced printer without reducing document throughput rate or requiring redirection of the documents exiting the interfaced printer into multiple processing paths. Accordingly, the general objects of the present invention are to provide novel and improved methods and apparatus of such character.

2. Description of the Prior Art

While not limited thereto in its utility, the present invention enables the addition of indicia, in selected color(s), to printed documents exiting a high speed electrographic or xerographic printer, i.e., in a preferred embodiment the present invention is a high volume printer with accent color capability. There has been a long standing and unmet need in the art of the ability to provide color enhancement to conventional black on white printed documents. Previous attempts to satisfy this demand, as will be briefly described below, have been unsatisfactory. For example, there has been a failure to address the need to preserve the significant investment of potential users in their existing, installed black print data printers and, particularly, to recognize that this investment has been made with a primary objective of increasing printing speed.

As an example of the prior art attempts to achieve high volume printing with multiple color capability, two color printing capability has recently been added to conventional xerographic apparatus by using two developers, one for black and one for a single accent color, operating at different voltages. This approach, however, has the disadvantage that it cannot offer full spectrum color capability on a high speed printer.

For users requiring or desiring more than a combination of black plus a single accent color, the only previous alternatives have been low speed systems characterized by high labor intensity and/or expensive investment in equipment. By way of example, a xerographic process employing multiple developers may be employed. Printers utilizing multiple developers are slow, typically five pages per minute maximum, and expensive. Ink jet printer technology also offers multiple color capability. However, the prior art ink jet technology employed water-based inks which imposed restrictions on the choice of paper being processed and, generally, presented problems with permanency as a result of moisture absorption. It is to be noted that ink jet technology is available which employs print media which is liquid in the jet and solidifies upon impact, such media typically being wax based. While the use of wax based inks provides excellent full color range, previously available printers employing this technology were notoriously slow.

Prior art transports for printing continuous forms employ rollers and web tension to drive the continuous form. Such transports are sensitive to changes in paper weight, moisture content, perforation strength and other paper characteristics and properties. Accordingly, previously available transports for continuous form paper were unsuitable for the overprinting, i.e., the addition of accent color, to previously printed documents because the requisite constancy of paper velocity could not be obtained.

Prior art sheet feeders, similarly, had the inherent disadvantages that previously documents could not be consistently accurately positioned for the addition of color indication while achieving adequate throughout rate.

SUMMARY OF THE INVENTION

The present invention overcomes the above-briefly discussed deficiencies and other disadvantages of the prior art by providing a hybrid printer system, and particularly a combination of an electrographic or xerographic printing process and full color spectrum ink jet printing. The ink jet printing system is located immediately downstream of the electrographic or xerographic apparatus, which prints black text on white and, preferably, is interfaced therewith so as to define a continuous paper path.

The present invention also encompasses a transport system which, in a first embodiment, reliably moves a continuous form or, in a second embodiment, reliably and serially moves individual sheets, comprised of various materials, sizes, thicknesses and textures. This transport system presents the documents, i.e., the pages to be printed, in orderly and predictable fashion for further processing. In accordance with a preferred embodiment, this further processing consists of high speed multi-color printing with a wax based ink. However, a transport system in accordance with the invention may be employed to deliver documents for imaging, personalization, labelling, etc. and these nondisclosed processing steps may be employed in conjunction with the multi-color printing.

An accent color printing system in accordance with the present invention is comprised of an infeed module, a timing module, a placement module, a processing module which defines a convexly curved paper path, plural printheads juxtapositioned to the curved paper path, and a discharge module which may include a document stacker or other peripheral equipment.

An object of the invention is to provide a printer capable of adding color indicia to a preprinted document.

Another object is to provide a color accent printer capable of a throughput rate equal to the throughput rate of a high speed host printer.

It is a further object of the invention to provide a printer capable of accurately depositing color indicia on a preprinted document.

It is yet another object of the invention to provide a color accent printer capable of exercising sufficiently accurate temperature control over documents, particularly preprinted documents, to thereby permit high quality color printing by an ink jet print head employing a wax based ink.

Still another object of the invention is to provide a paper transport system capable of accurate document positioning regardless of paper moisture content, paper thickness or other paper characteristics.

It is still a further object of the invention to provide a paper transport path capable of supporting and positioning a document for high accuracy printing.

These and other objects of the invention will be made clear from examination of the specification and drawings.

BRIEF DESCRIPTION OF THE DRAWINGS

The present invention may be better understood, and its numerous objects and advantages will become obvious to those skilled in the art, by reference to the accompanying drawings wherein like reference numerals refer to like elements in the several figures and in which.

DETAILED DESCRIPTION OF THE DISCLOSED EMBODIMENTS

Figure 1:
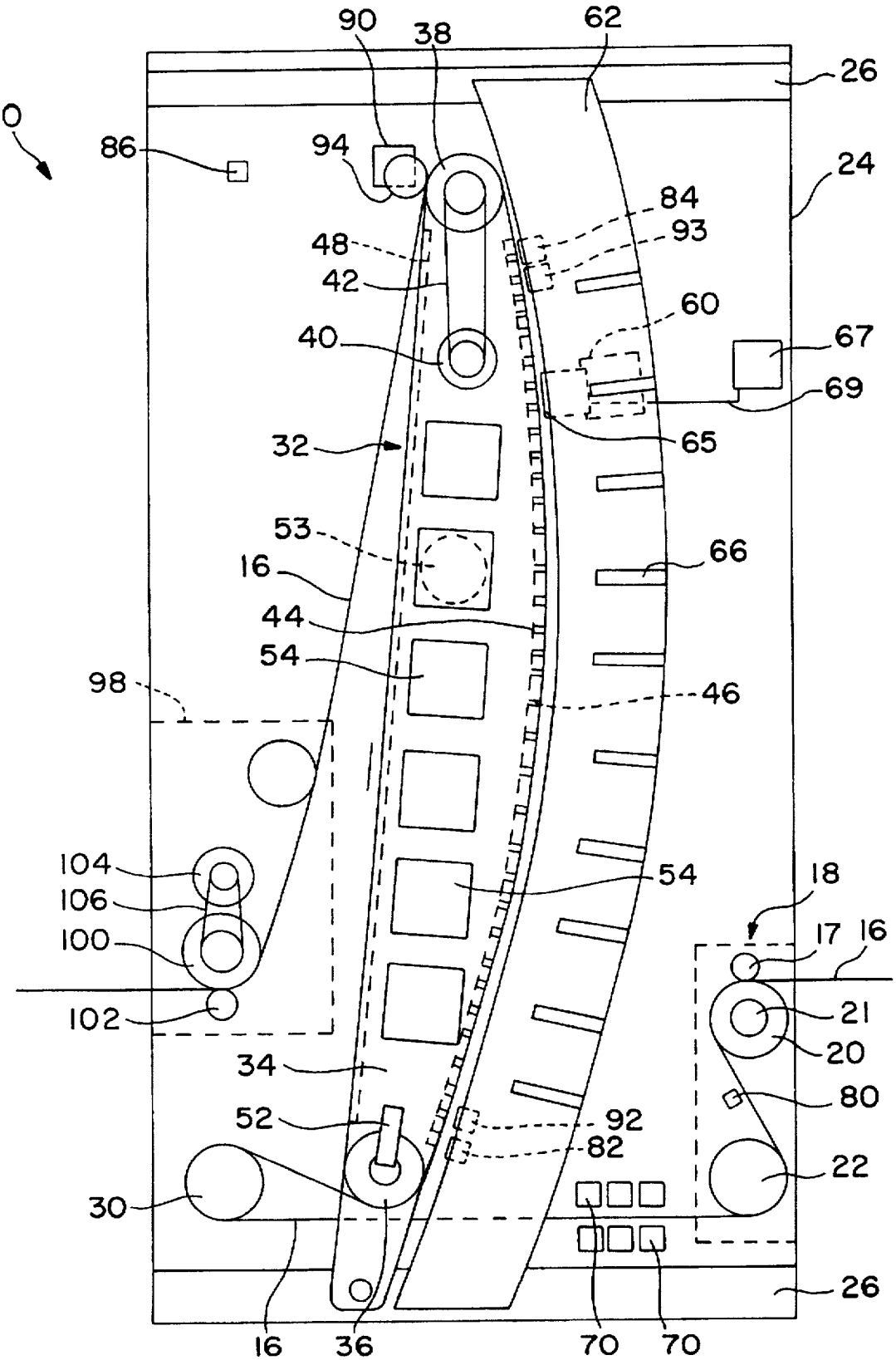
FIG. 1 is a schematic, partial, cross-sectional, side elevation view, partially broken away and partially in phantom, of a first embodiment of an accent color printer in accordance with the invention.
Figure 5:
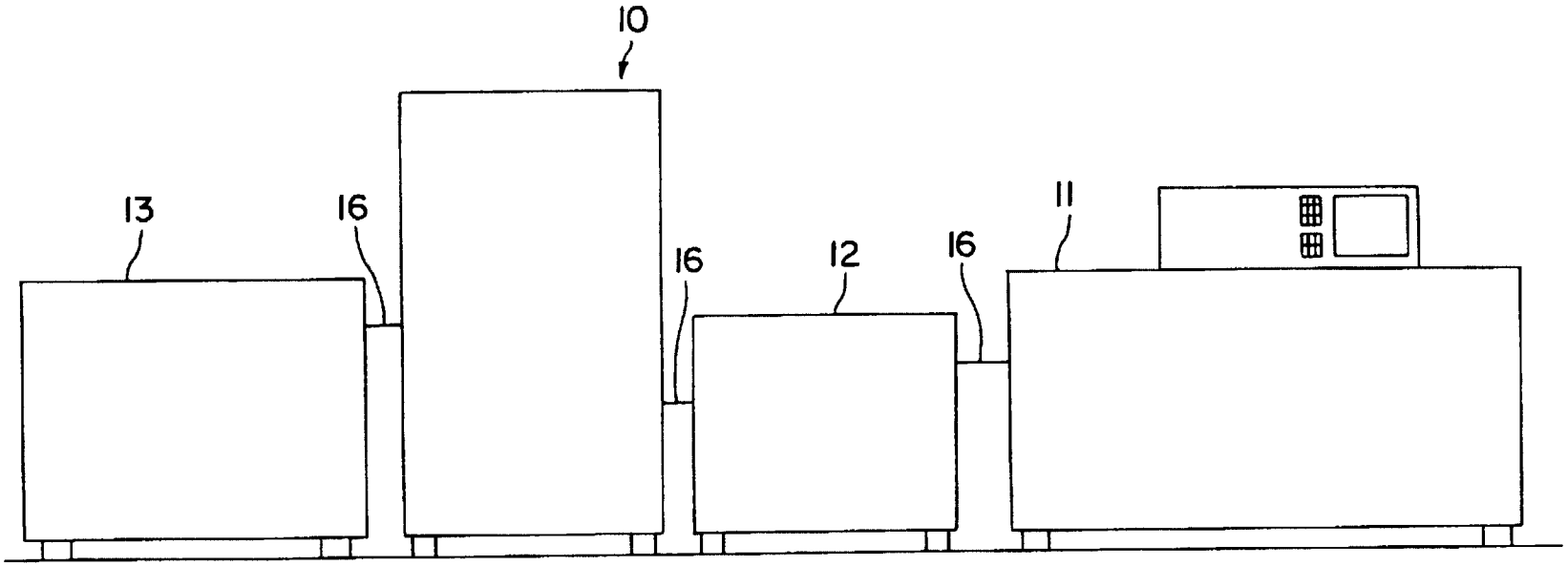
FIG. 5 is a side elevation view of a complete printing system arrangement which includes the color accent printer of FIGS. 1–4.

With reference to the drawings, an accent color printer, indicated generally at 10 in FIGS. 1 and 5, receives a continuous form or web 16 of preprinted material for the addition of color indicia including text, and/or graphics and/or highlighting. An input interface 12, comprising a web control unit, functions to transfer the continuous form 16 of preprinted material from a xerographic or other type host printer 11 to the accent color printer 10. Typically, the host printer 11 will be a high-speed, single-color printing device reproducing multiple copies of the same document on a continuous form or web, or multiple copies of individual documents.

The material comprising the continuous form or web 16 is typically a continuous length of paper having a row of tractor feed holes along each longitudinal edge. Documents are printed on the "pages" of the web in repetitive fashion. A predetermined number of tractor feed holes correspond to each page or document of the continuous form. Alternately, the continuous form may lack tractor feed holes, and the host printer 11 will print a top of form mark on the continuous form 16 to designate the beginning of each document on the web. It should be recognized that the invention is not limited to accent printing on the same document or to accent printing only on a continuous form. As will be discussed below in the description of FIGS. 6–8, the invention is also applicable to single sheet printing of documents. For single sheet printing, alternative infeeds and outfeeds may be required.

The input interface 12 serves as a buffer between the high-speed host printer 11 and the accent color printer 10. (See FIG. 5.) The input interface 12 is a mechanical connection which provides slack in continuous form 16 to compensate for variations between the throughput rates of the high-speed host printer 11 and the accent color printer 10. The input interface 12 is thus a web control which, in a manner known in the art, produces a free loop of continuous form 16 between the host printer 11 and the accent color printer 10. The input interface 12 further buffers differences in data transfer sequences and error recovery sequences for paper jams between the two printers 10, 11.

The continuous form 16 exiting the input interface 12 is first fed into an in-feed system 18 of the accent color printer 10. (See FIG. 1.) The in-feed system 18 and the other components of the accent color printer 10 are supported in a printer cabinet 24 having a cabinet frame 26. The in-feed system 18 comprises a plurality of rollers which cooperate to impart a continuous and consistent tension to the continuous form 16 downstream of in-feed system 18. The continuous form 16 feeds through the in-feed system 18 in a generally S-shaped path over an upper in-feed roller 20 and around a lower in-feed roller 22. The upper in-feed roller 20 is coupled to a chassis ground via a hysteresis clutch 21. The continuous form 16 is "grounded", i.e., held between, the upper in-feed roller 20 and pinch rollers 17. The pinch rollers 17 prevent slippage of the continuous form 16 on the upper in-feed roller 20. The hysteresis clutch 21 is a variable torque device settable at a preestablished level and embodied within the design to allow a web tension proportional to the torque. In operation, the hysteresis clutch 21 creates drag on the upper in-feed roller 20 to thereby tension the grounded continuous form 16. The tension added to the continuous form 16 should be low, typically ¾ pound per inch of web.

The continuous form 16 of preprinted material exiting the in-feed, i.e., tension control, system 18 is delivered to a heated roller 30. After passing over the heated roller 30, the continuous form 16 is guided to a vacuum belt conveyor, indicated generally at 32.

Figure 2:
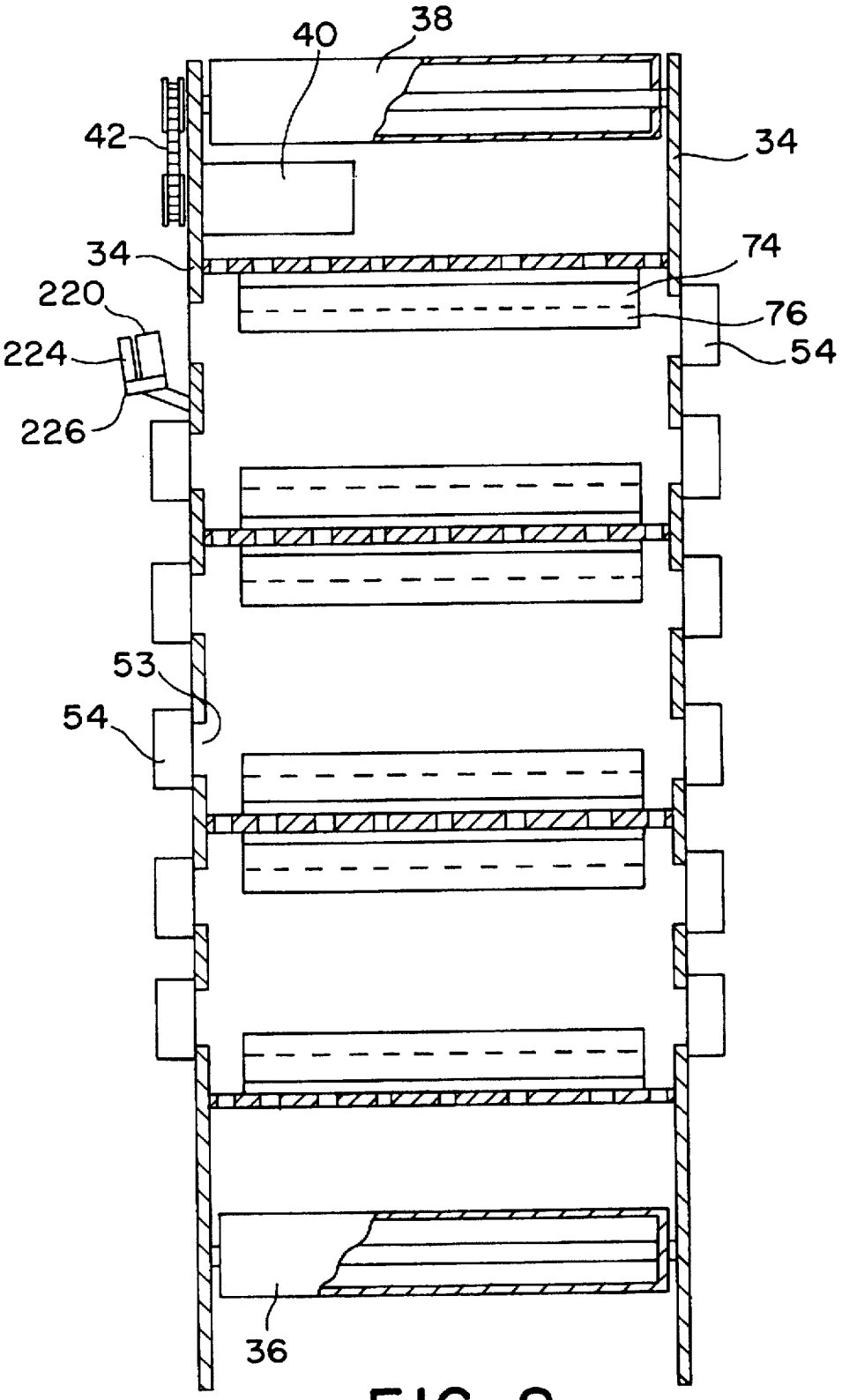
FIG. 2 is a schematic, partial, cross-sectional, front elevation view, partially in phantom and partially broken away, of the vacuum belt conveyor of the accent color printer of FIG. 1, with the vacuum belt removed.

The vacuum belt conveyor 32 supports, positions and moves the continuous form 16 for printing by a plurality of adjustable position print head systems 60 (only one of which is shown in FIG. 1). The vacuum belt conveyer 32 comprises a pair of parallel spaced apart, elongated generally D-shaped side frames 34. (See FIGS. 1 and 2.) The side frames 34 are substantially vertically oriented in the printer cabinet 24 and define an upper conveyor end and a lower conveyor end. The generally vertical orientation of the vacuum belt conveyor 32 permits a compact construction of the accent color printer 10; however, the accent color printer 10 is operable with the vacuum belt conveyor 32 at other orientations. Conveyor 32 includes a lower belt drum 36 rotatably supported at the lower conveyor end between the side frames 34. An upper belt drum 38 is also rotatably supported between the conveyor side frames 34 at the upper conveyor end. The upper belt drum 38 is driven by a motor 40 through a drive belt 42. The speed of the motor 40 is controlled by the slack or a hanging loop of continuous form 16 created at the input interface 12. The length of a loop of the continuous form 16 is between the host and accent color printer and is monitored by the input interface 12. When the loop grows beyond a preestablished limit, the speed of the motor 40 is increased. When the length of the loop of the continuous form 16 falls below a preestablished limit, the speed of the motor 40 is decreased. Changes in speed of the motor 40 are made at a slow rate so as not to adversely affect print quality.

Located between the side frames 34, and defining a curved or arced paper path between the belt drums 36 and 38, is a tension side sliding bed 44. The tension side sliding bed 44 comprises a platen which defines a generally arc-shaped, i.e., convex, surface over which a vacuum belt 50 moves. Also positioned between the side frames 34, along the straight back edge of the frames, is a slack side sliding bed 48. The tension side sliding bed 44 is provided with a multiplicity of perforations 46.

The side frames 34 are pivotally mounted to the cabinet frame 26 near the lower conveyor drum 36 to allow pivoting of the vacuum conveyor 32 away from the print head systems 60. The print head systems 60 are mounted to a print frame 62. The print frame extends from the top to the bottom of the cabinet 24. The print frame 62 is rigidly held in a fixed position by attachment to the cabinet frame 26 at the upper and lower ends of the print frame 62.

Figure 3:
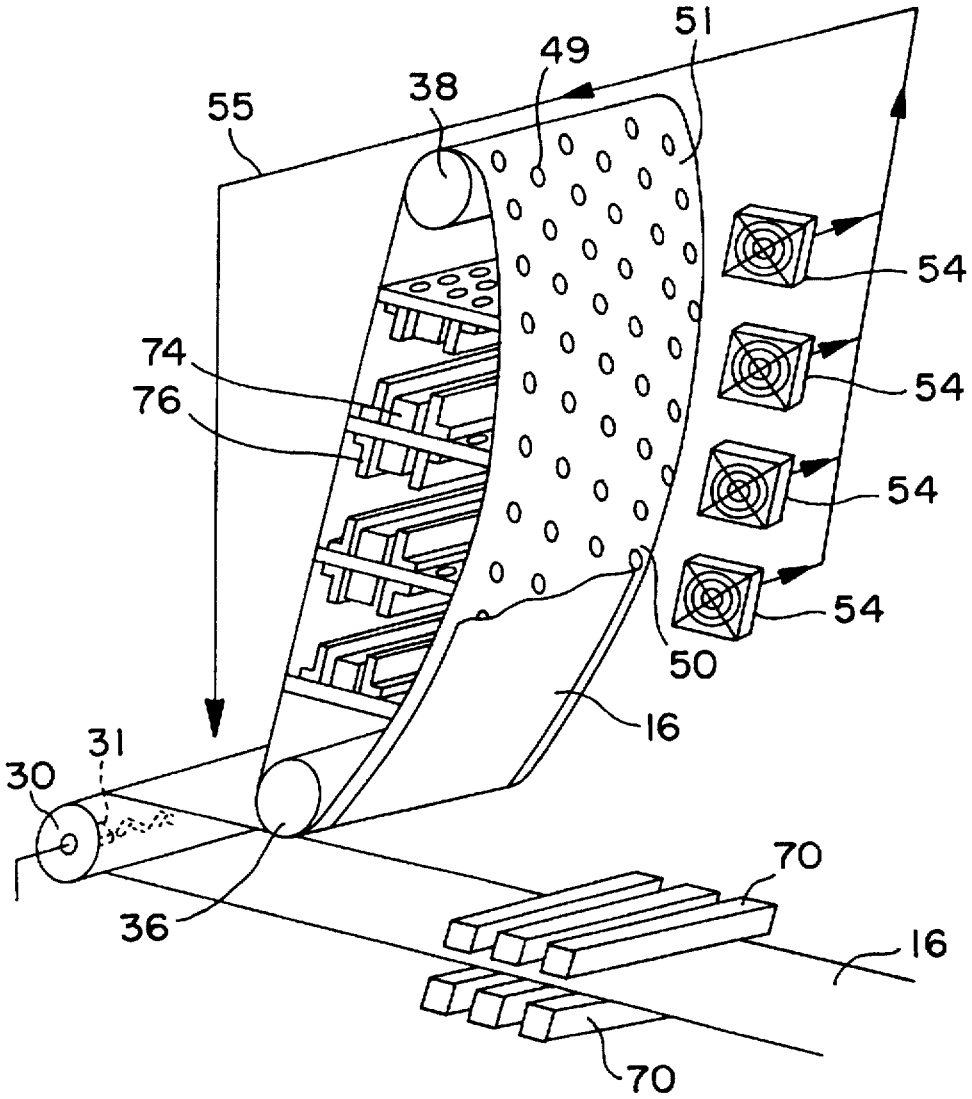
FIG. 3 is a partial, schematic, perspective view, partially in phantom and partially broken away, of the vacuum belt conveyor and heating system of the accent color printer of FIGS. 1 and 2.
Figure 4:
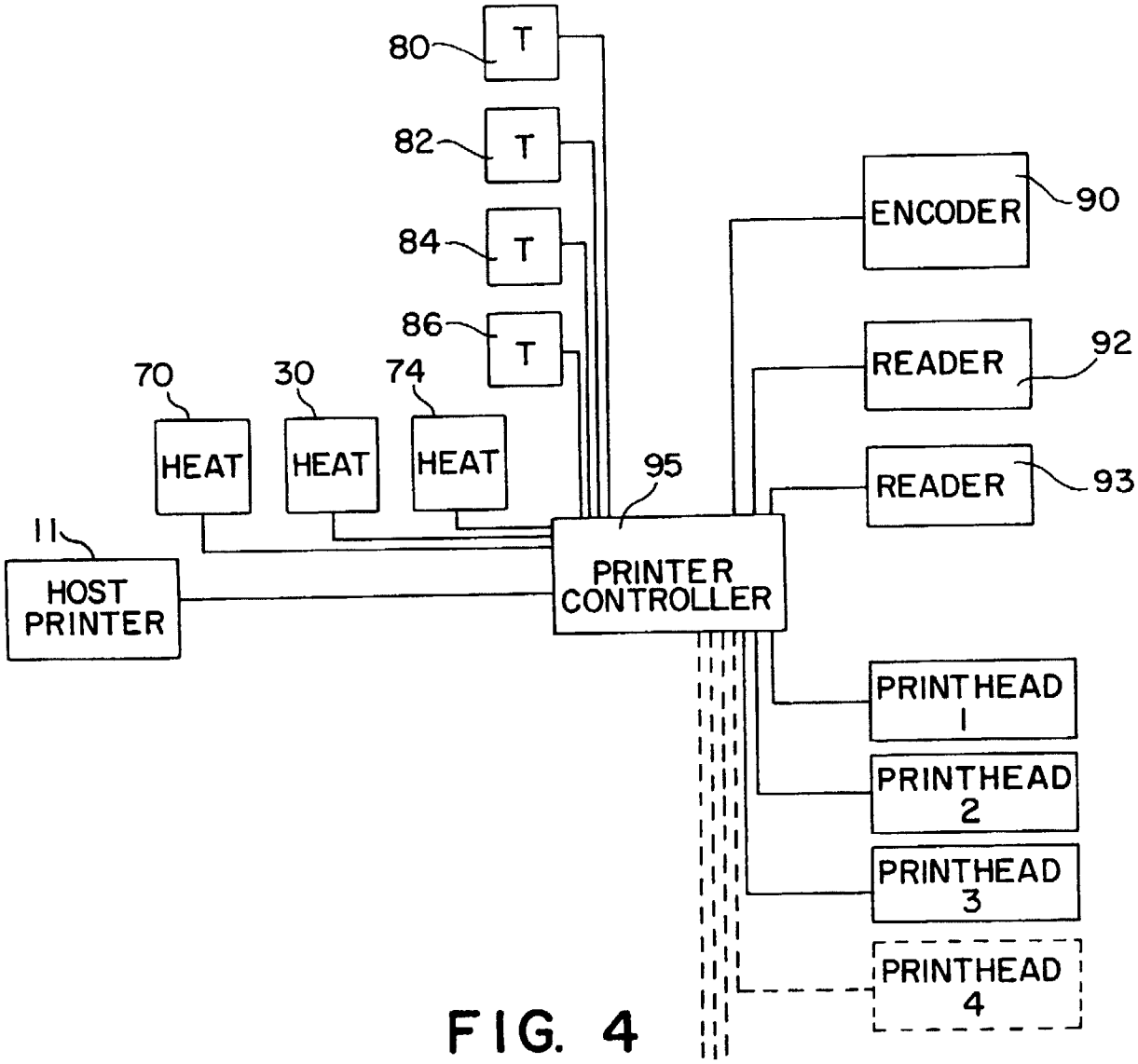
FIG. 4 is an electrical circuit block diagram of the printer controller and associated components of the color accent printer of FIGS. 1–3.

The vacuum belt 50 is in the form of a continuous loop which travels over the upper belt drum 38, along the slack side sliding bed 48, around the lower belt drum 36 and along the tension side sliding bed 44 to return to the upper belt drum 38. The vacuum belt 50 provides a transport surface 51 for moving the continuous form 16. The arc defined by the side frames 34 and the tension side sliding bed 44 tensions the vacuum belt 50 over the tension side sliding bed 44 as the vacuum belt is driven by the upper belt drum 38. The tension in the vacuum belt 50 produces very smooth belt operation over the tension side sliding bed 44 without wandering or unevenness of belt motion. The vacuum belt 50 is provided with an arrangement of perforations 49 (see FIG. 3) over the entire surface of the belt. A belt tension adjuster 52 permits vertical motion of the lower belt drum 36 to adjust the tension in the vacuum belt 50 and to allow the axis of rotation of the lower belt drum 36 to be adjusted parallel to the axis of rotation of the upper belt drum 38.

Accurate positioning of the upper and lower belt drums 36, 38 and the curved shaped of the tension side sliding bed 44 result in elimination of the requirement for edge registration of the vacuum belt 50. Consistent tracking of the vacuum belt 50 is significant since wander of the vacuum belt perpendicular to the paper path direction would cause lateral motion of the continuous form 16 with the result of deteriorated indicia print quality. Should edge registration of the vacuum belt 50 be desired, edge rollers (not shown) may be provided at an edge of the vacuum belt to continually stabilize the registration of the vacuum belt 50. Other methods of preventing belt wander, such as a fixed guide rail, could also be provided.

The arc defined by the tension side sliding bed 44, in one reduction to practice, had a radius of approximately 96 inches. Modification in the arc radius can occur without compromising print quality, however, an approximate 96 inch radius has provided optimal results. Increases in the arc radius of over approximately 20%, or greater than approximately 120 inches, result in a significant decrease in belt tension on the arced tension side sliding surface. Reduced tension leads to increased belt motion and therefore decreased print quality. The curved path of the vacuum belt 50 as it slides over the arced tension side sliding surface allows the continuous form 16 to remain in intimate contact with the belt 50 for the length of the conveyor tension side. The curved path followed by the vacuum belt, furthermore, allows a very smooth running motion with little "hop" or displacement of the vacuum belt 50 from the tension side sliding bed 44 that could compromise print quality. The characteristic of intimate contact between the continuous form paper 16 and the vacuum belt 50, combined with the smooth operation of the belt 50 on the conveyor 32, are critical for proper print registration and therefore high quality color indicia printing.

The vacuum belt conveyor 32 supports the continuous form 16 on the vacuum belt 50 by creating a pressure differential across the form 16. This is accomplished by "evacuating" air from the interior chamber 56 of the vacuum belt conveyor 32, therefore drawing air in through the vacuum belt perforations 49 and tension side sliding bed perforations 46. Both conveyor side frames 34 define a series of air flow ports 53 which communicate with the vacuum chamber 56. A fan 54 is located over each port 53 and affixed to a conveyor side frame 34. Ports 53 and fans 54 can also be provided on only a single conveyor side frame 34, depending on fan air flow capacity. The fans 54 exhaust air from the vacuum chamber 56, the chamber being defined in part by the side frames 34 and the sliding beds 44, 48.

The vacuum chamber 56 is separated into a series of vacuum compartments 73 by perforated dividers 75. (See FIGS. 2 and 3.) The internal baffling of chamber 56 created by the dividers 75 reduces the overall requirement for vacuum. The use of separate but interconnected vacuum compartments 73 results in a very uniform holding force over the entire transport surface 51 of the vacuum belt 50. The uniform low pressure produced in the vacuum chamber 56 assists in preventing any wandering side to side by the continuous form 16 on the transport surface 51. The established pressure differential further allows the vacuum belt 50 to move the continuous form 16 in the paper path direction. The curved shape of the transport surface 51 and the uniform vacuum holding force on the transport surface 51 results in an even tension on the continuous form 16, therefore providing an ideal surface for printing.

Use of the vacuum belt conveyor 32 for transport of the continuous form 16 further provides a transport system insensitive to changes in paper weight, moisture content, perforation strength and other variable characteristics of the paper comprising the continuous form 16.

During the printing process, the vacuum belt conveyor 32 moves the transport surface 51 supporting the continuous form 16 past the multiple print head systems 60. For accurate and high quality printing, the transport surface 51 must provide highly accurate and wander-free dynamic positioning of form 16 as it moves past the print head systems 60. Vertical wandering, i.e., side-to-side movement perpendicular to the travel direction of the transport surface 51 of equal to or greater than 0.003 inch will cause a visible print anomaly.

The continuous form 16 containing the added color indicia printed in the manner to be described below, is drawn away from the vacuum belt conveyor 32 near the upper belt drum 38. (See FIG. 1.) The continuous form 16 then travels downwardly to an outfeed system 98. The outfeed system comprises a single rotating outfeed drum 100, driven by a type AC motor 104, and multiple spring loaded contact rollers 102. The continuous form 16 is fed through a nip created by the outfeed drum 100 and the contact rollers 102. The AC motor 104 is coupled to the outfeed drum 100 by a drive belt 106. The outfeed drum 100 is driven so the nominal surface speed thereof is faster than the surface speed of the vacuum belt 50. The AC motor 104 is sized such that there is limited torque available and, accordingly, the AC motor 104 runs at a continuous slip angle so as to be at the same surface speed as the surface speed of the vacuum belt 50. The outfeed system 98 thus maintains tension in the continuous form 16 as it exits the accent color printer 10. The continuous form 16 exiting the accent color printer 10 via the outfeed system 98 is subjected to further processing such as cutting, stacking, compiling, etc. by post-printing document processors 13.

As noted above, color indicia, such as text, graphics and highlighting, is added to the documents that comprise the continuous form by an array of print head systems 60. The array of preferably eight print head systems 60 are supported in juxtapositioned relationship to the tension side of conveyor 32 by the print frame 62.

Figure 9:
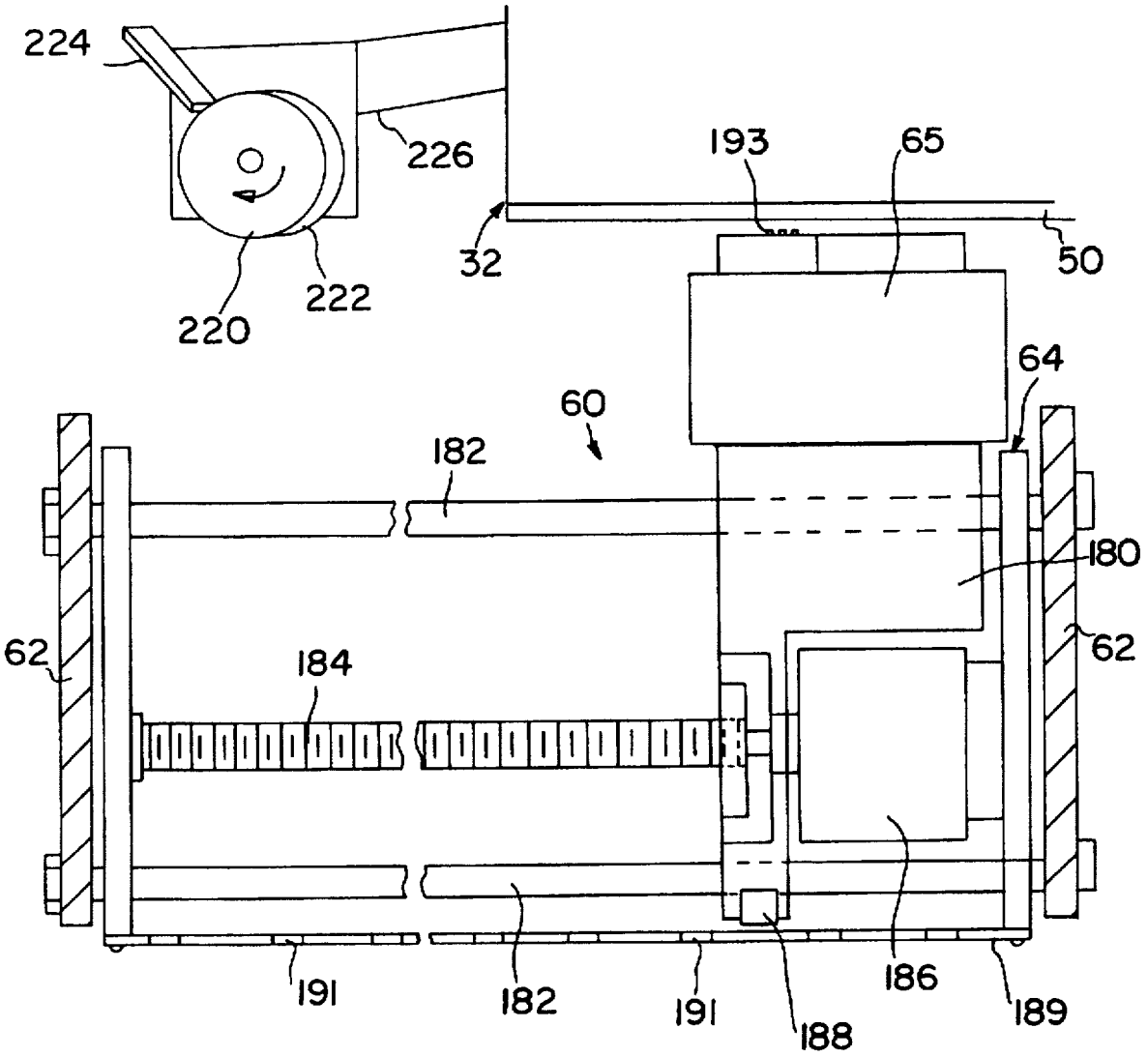
FIG. 9 is a partial cross-sectional view, partially in phantom, of the print head system of the apparatus of FIGS. 1–3.
Figure 10:
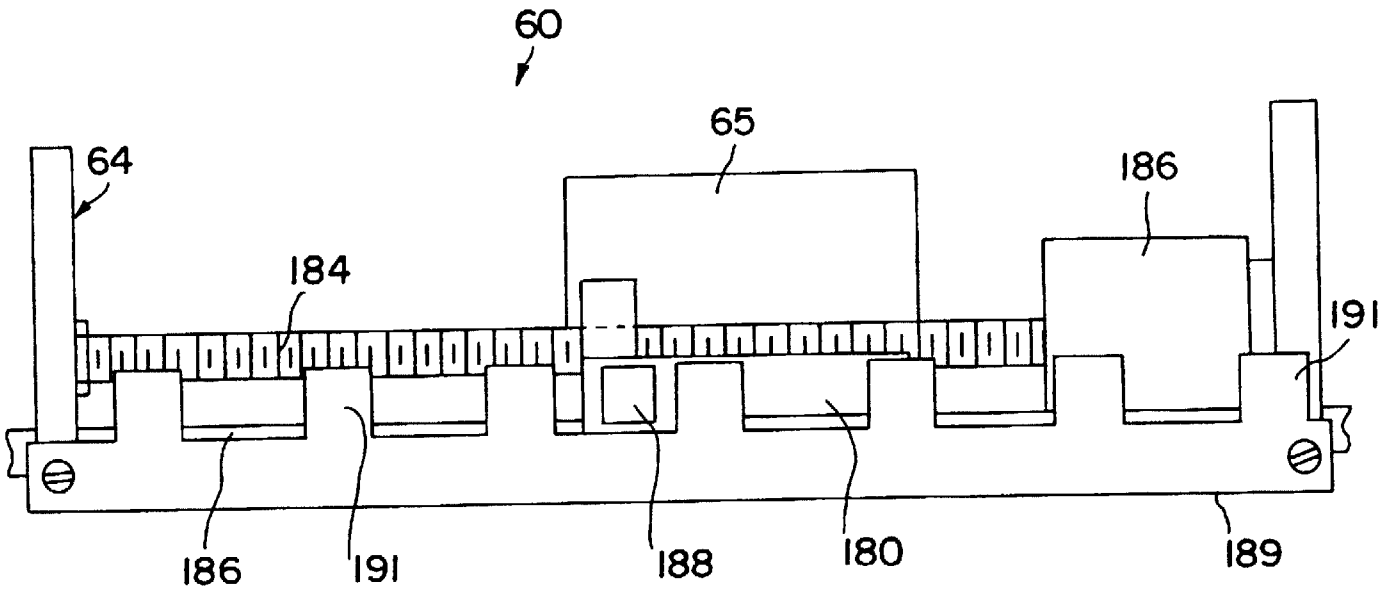
FIG. 10 is a side elevation view, partially in phantom, of the printhead system of FIG. 9.

Referring to FIGS. 9 and 10, each print head system 60 comprises a print head support 64 and a print head 65. The print heads 65 each preferably employ an array of 96 ink jets to spray wax based inks. The print heads 65 are evenly spaced along the paper path in the process direction by printhead supports 64 which are located in slots 66 on the printer frame 62. Each print head support 64 comprises a print head carriage 180 mounted for movement on parallel printer tracks 182. The printer tracks 182 are oriented orthogonal to the travel direction of the transport surface 51. Backlashless actuator screws 184 precisely locate and fix the position of each print head carriage 180. Each actuator screw 184 is driven by a motor 186 to position the printer carriages 180, and therefore the print heads 65, orthogonal to the print path. The tolerance for the actuator screw is preferably at least 0.004 inches per foot to permit print head positioning of plus or minus ½ pixel or 0.0018 inches arranged in a direction orthogonal to the process direction.

The print head positioning over the paper path utilizes an optical positioning sensor 188 and a reference gauge 189. The positioning sensor 188 is mounted on the print head carriage 180. The reference gauge 189 is a precisely machined bar having indicator blocks 191 at precise positions. The positioning sensor 188 "reads" the position of the indicator blocs 191. The reference gauge 189 is used to verify the position of the print head carriage 180 along the actuator screw 184. The position of the print head 65 must be verified to an accuracy greater than the industry tolerance for the actuator screws 184 employed to move the print head carriage 180. The positioning sensor 188 verifies the position of the print head 65 by edge detection of the very accurately manufactured reference gauge 189. It should also be recognized that a laser and an optical receiver, not shown, could be employed for sensing print head position.

Each print head support 64 permits positioning of its single associated print head 65 along an axis orthogonal to the paper path, i.e., the process direction. In the typical use, once the print head support 64 has been adjusted to position the print head 65 for printing a particular document, the print head 65 remains in a fixed position relative to the paper path and does not move during the actual repetitive printing process.

Figure 11:
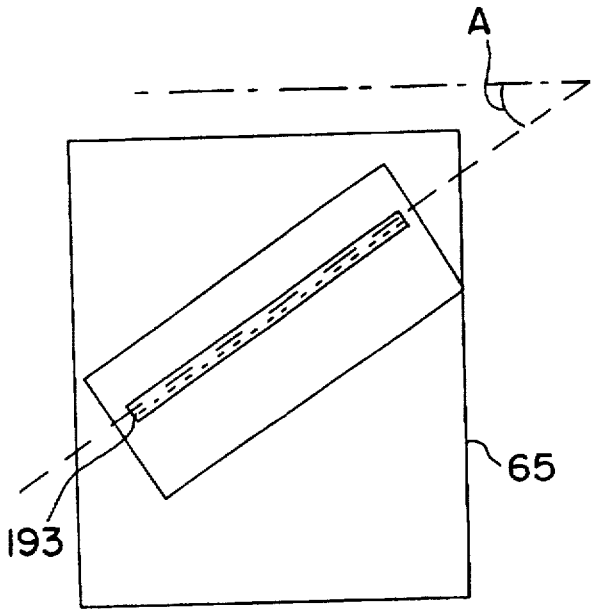
FIG. 11 is a front elevation of the printhead system of FIG. 9.
Figure 11A:
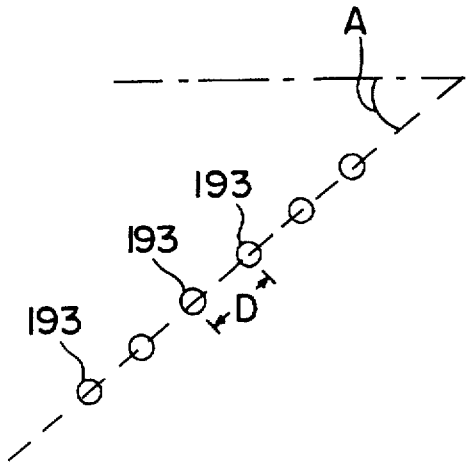
FIG. 11*a* is a detail view of the ink jets of the printhead of FIG. 11.

The print heads 65 are mounted to the print head carriages 180 at an angled orientation to the process direction or paper path. Each print head 65 is skewed at a defined angle A directly related to the printing resolution required. (See FIGS. 11*a* and 11*b*.) The angle is determined from the distance D between each ink jet 193 and the required resolution. The greater the required resolution for a given print head 65, the less the angle A from the paper path. In one reduction to practice the print heads 65 each had ninety-six ink jets. The ink jets were spaced 0.269 in. from each other. The print heads 65 were angled at 82°, providing for a resolution of approximately 300 pixels/inch. Therefore, the accent color printer 10 provided for eight printed swaths of color indicia that could be added to a preprinted document, each swath having an approximate width of 3/10 of an inch. These combined eight swaths provided for a page coverage of about 1%. While it is preferable to mount a single print head 65 to each print head carriage 180, it should be recognized that multiple print heads 65 may be mounted to a single carriage 180 as a method of increasing indicia printing width.

The angle of the print heads in part defines the acceptable operational limits on the radius of the arc defined by the vacuum belt conveyor 32. The greater the angle A, the greater the required arc radius. This direct relationship arises from the linear orientation of the ink jets. Ink jets at the end of the linear array for a printhead 65 are positioned farther from the continuous document 16 on the vacuum belt conveyor 32 than ink jets at the center of the array. A solution is a curved array of ink jets having a radius commensurate with the array of the vacuum belt conveyor. In one reduction to practice for a linear array of 96 ink jets, at about 82°, a radius of 96 inches is a practical minimum arc radius for the vacuum belt conveyor. An ink jet array, oriented so as to be generally orthogonal to the path direction, would permit a small or arc radius for the vacuum belt conveyor 32. It should be recognized that the invention is not limited to a curved vacuum belt conveyor of a constant radius, but the invention encompasses other convex curves for the tension side of the vacuum belt conveyor 32.

The print heads 65 provide the ability to add up to eight separate colors of indicia to a document supported on the vacuum belt conveyor 32. The print heads 65 are supplied from a heated ink reservoir 67 that maintains the wax based ink in a fluid state. The ink reservoir 67 further pressurizes the fluid ink to the ink jets of the print head 65 over fluid lines 69 for printing. The reservoir 67 can comprise from one to eight chambers to provide one to eight possible colors.

The ink jets employed in the invention require periodic cleaning in order to maintain high quality printing. Ink jet cleaning is a two step process involving first purging and then wiping the jets. A roller 220 is rotatably mounted near one end of the print head support 64. (See FIGS. 2 and 9.) The roller 220 is preferably comprised of a synthetic material such as silicone or urethane having a durometer hardness of approximately 40 Shore "A". The print frame 62 and the printhead support 64 have a width greater than the vacuum belt conveyor 32. The roller 220 is supported adjacent the side of the vacuum belt conveyor by a roller support 226 extending from the side frame 34. The roller 220 is oriented to have the same angle "A" as the ink jets 193 of the print head 65. Therefore, the roller 220 and ink jets 193 are on the same centerline. The roller 220 is positioned to contact the ends of the ink jets 193 when the printhead carriage is moved beyond the edge of the vacuum belt conveyor 32. The printhead 65 is preferably moved to the cleaning position in response to motor 186 driving the actuator screw 184. The print head is positioned such that the ink jets 193 contact the surface of the roller 220. The roller 220 is positioned so the ink jets 193 are forced slightly into the roller surface 222. The angle of the roller 220 permits the roller 220 to at least partially seal all of the ink jets 193, therefore providing sufficient back pressure for the purging of the ink jets 193.

After purging of the ink jets is completed, the printhead carriage 180 next moves the print head 65 past the roller 220 in a direction away from the vacuum belt conveyor 32. The printhead carriage 180 is then reversed in direction to pass the roller 220 a second time. The roller 220 is constructed to only rotate in a direction wherein the roller rotates when the printhead 65 initially passes the roller 220. When the printhead 65 moves in the reverse direction, the roller 220 wipes the ink jets 193 of excess wax due to nonrotation of the roller 220. A blade 224 is positioned to contact the roller surface 222 and therefore scrape excess wax from the roller 220. The roller 220 is preferably constructed of silicone because of the superior release properties of wax from a silicone surface, therefore increasing scraping efficiency by the blade 224.

Paper temperature is an important factor in maintaining consistent and high print quality with wax based inks. The required paper temperature is determined by the wax parameters of the wax based ink. The optimum paper temperature of 63° C. maintains the wax in a slushy state to produce high quality printing results. Higher than optimum paper temperatures causes excess wicking of the ink into the paper fiber and therefore decreased print resolution. Lower than optimum paper temperature causes inadequate ink penetration and mere surface adhesion of the ink to the paper. For consistent high quality printing, the paper temperature needs to be maintained in the range of plus or minus 3° Celsius.

The temperature of the continuous form 16 arriving at the input of the color accent printer 16 is generally below the optimum paper temperature. Finned strip cabinet heaters 70 are provided at the bottom of the cabinet 24 above and below the path of the continuous form 16 as the continuous form 16 moves from the infeed roller system 18 to the heated roller 30. The cabinet heaters 70 serve to heat the paper of the continuous form 16 and, while so doing, to also raise the general ambient temperature inside the cabinet 24. The cabinet 24 is insulated with rigid foam insulation 72 to reduce the energy requirements of the cabinet heaters 70. The cabinet 24 is further sealed to provide increased retention of heated air within the cabinet 24. Heated roller 30 is provided with an internal quartz bulb heater 31 to provide additional heating by conduction to the continuous form 16.

The vacuum chamber 56 of the vacuum belt conveyor 32 is also provided with a series of internal strip heaters 74 to maintain the vacuum belt 50, and therefore the continuous form 16, within the optimum temperature range. The internal strip heaters 74 are provided with heat shields 76 to prevent the creation of hot spots on the vacuum belt 50 (see FIGS. 2 and 3). An important function of the internal heaters 74 is to maintain the continuous form 16 at a consistent temperature past each of the eight print heads 65. Achieving and maintaining optimum paper temperature is further insured by ducts 55 directing heated air, drawn from the vacuum chamber 56 by the vacuum fans 54, towards the incoming continuous form 16.

Temperature sensors monitor web temperature and control the cabinet heaters 70, heated roller 30 and internal heaters 74 of the vacuum belt conveyor 32 in response to the measured paper temperature. The heat sensors comprise an infeed temperature sensor 80, a lower conveyor temperature sensor 82, an upper conveyor temperature sensor 84 and a cabinet temperature sensor 86. The cabinet heaters 70 and the heated roller 30 are adjusted in response to the in-feed temperature sensor 80, the lower conveyor temperature sensor 82 and the upper temperature sensor 84. The internal heaters 74 are controlled in response to the cabinet temperature sensor 86. (See FIG. 6.)

A significant factor for high quality, high speed printing is determination of exact document positioning to permit accurate integration of the desired color indicia into the preprinted document. Reliable and wander-free document placement orthogonal to the feed path direction is obtained by the previously described vacuum belt conveyor 32. Document position in the paper path direction is accurately determined by the combination of an encoder 90 and a pair of position readers 92, 93. (See FIGS. 1 and 12.) Paper position is initiated at the beginning of a printing run by manually adjusting the continuous form 16 to align with a registration mark on the vacuum belt conveyor 32. The encoder 90 and the upper and lower position readers 92,93 are then initialized to begin measuring document position on the continuous form 16. Document position is generally determined by the encoder 90 which comprises an encoder wheel 94 in contact with the vacuum belt 50.

Figure 12:
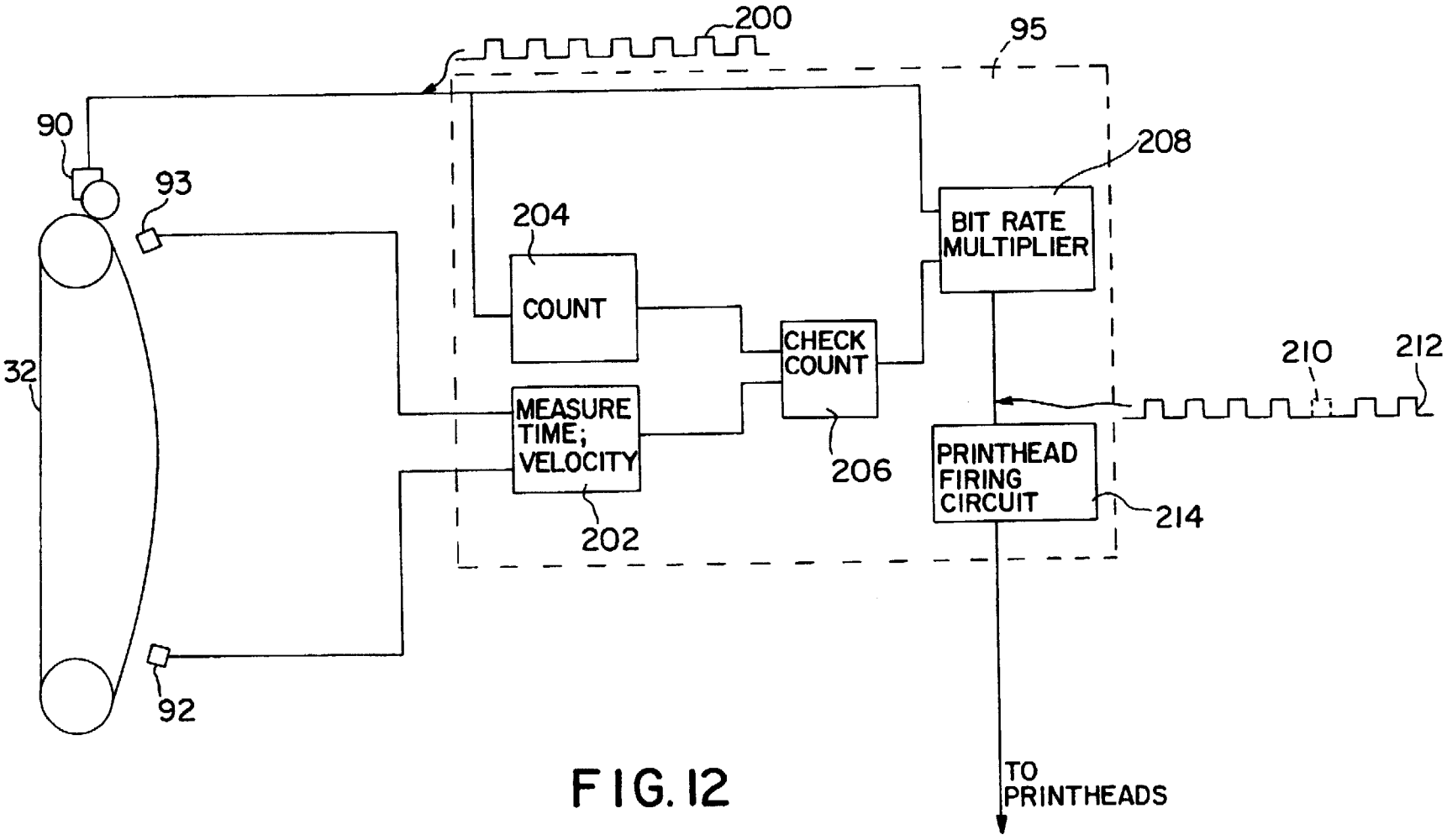
FIG. 12 is a schematic view of the document positioning system of the color accent printer of FIGS. 1–3.

With reference to FIG. 12, motion of the vacuum belt 50 causes rotation of encoder wheel 94, thereby generating an encoder signal 200 comprising a series of pulses, having a repetition rate commensurate with vacuum belt velocity, which is transmitted to the printer controller 95. Vacuum belt speed determines the continuous form position. To adjust for "creep" between the continuous form 16 and the vacuum belt, the upper and lower position readers 92, 93 directly read paper position. For conventional continuous forms or webs, a series of tractor feed holes are positioned along each edge of the web. The lower position reader 92 counts the number of holes to continuously determine the top or leading edge of each document or page of the continuous form 16. The lower position reader 92 then transmits a first reader signal to the printer controller 95. The upper reader also reads the leading edge of the same document when the document is on the upper portion of the vacuum belt conveyor 32. The upper position reader 93 then transmits a second reader signal to the printer controller 95. The printer controller 95 is preprogrammed with the distance between the upper and lower position readers 92, 93. A computation circuit 202 in printer controller 95 measures the elapsed time between generation of the first reader signal and the second reader signal and utilizes the elapsed time and the known distance between readers 92 and 93 to accurately determine document velocity.

The readers 92, 93 can also read a top of form mark printed on each document of the continuous form, or the leading edge of individual separate documents.

The belt velocity, determined by circuit 204 from the encoder 90 pulse train, is compared with the paper velocity as determined by circuit 202 in comparison circuit 206. If the velocities are not equivalent, circuit 206 transmits a signal to a bit rate multiplier 208 to remove a pulse 210 from the signal 200 to create an accurate timing signal 212 that is transmitted to the print head firing circuit 214. The print head firing circuit signals each print head 65 when to fire. The deletion of a pulse 210 from the encoder signal 200 compensates for the small backward slip or "creep" of the continuous form on the vacuum belt 50. Accordingly, the ink jet firing enablement signal is continually adjusted to compensate for minor differences in the belt velocity, as measured by the encoder 90, and the actual continuous form velocity. The printer controller 95 can therefore determine an accurate position for each document on the transport surface 51.

Once the top of the document is determined, the printer controller 95 can accurately time the firing of the print head ink jets to properly position the color indicia. Accurate determination of document position and velocity permits the printer controller 95 to determine the printing timing sequence for one pixel relative to the speed of the transport surface 51.

The printer controller 95 provides designation and timing signals to each print head 65. The designation signal indicates the particular print head ink jets which will fire. The host printer 11 transmits a compressed format bitmap of the required color accents to the printer controller 95. The printer controller 95 decompresses the bitmap, cues up the image for printing at the proper time and generates a designation signal for each print head 65. The timing signal generated by the print head firing circuit 214 controls the actual firing of the ink jets which are enabled by the designation signal. The printer controller 95 further permits the combination of the individual ink jet swaths to create multiple swath widths. More specifically, each print head 65 can, at the beginning of a print run, be physically adjusted to print precisely adjacent to the swath of another print head 65. The print controller then "matches" the edges of two or more print swaths together to allow the printing of larger and continuous indicia.

Figure 6:
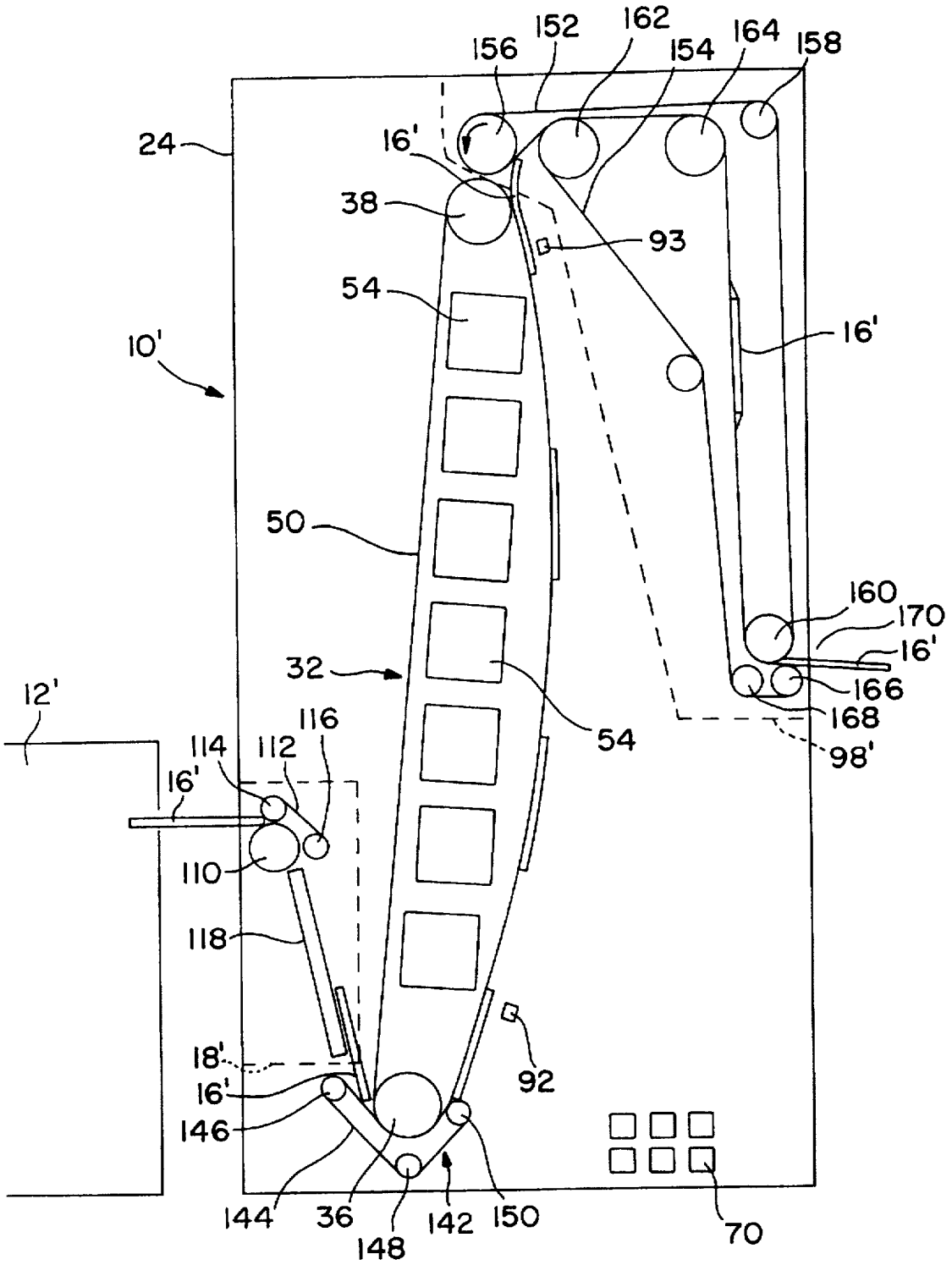
FIG. 6 is a schematic, partial, cross-sectional, side elevation view, partially broken away, of a second embodiment of a color accent printer in accordance with the invention.
Figure 7:
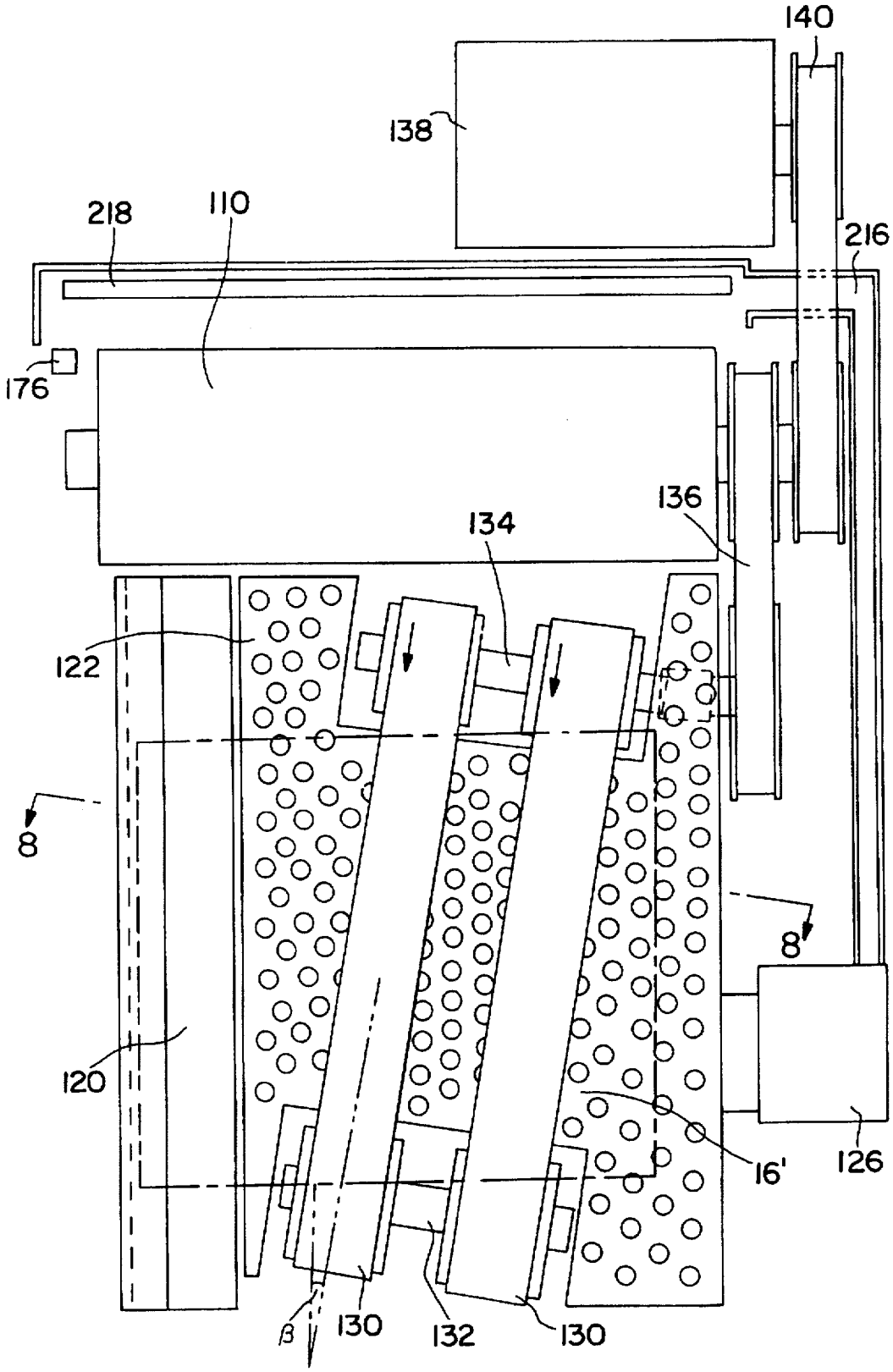
FIG. 7 is a front view, partially broken away and partially in phantom, of the sheet aligner of the transport of the embodiment of FIG. 6.
Figure 8:
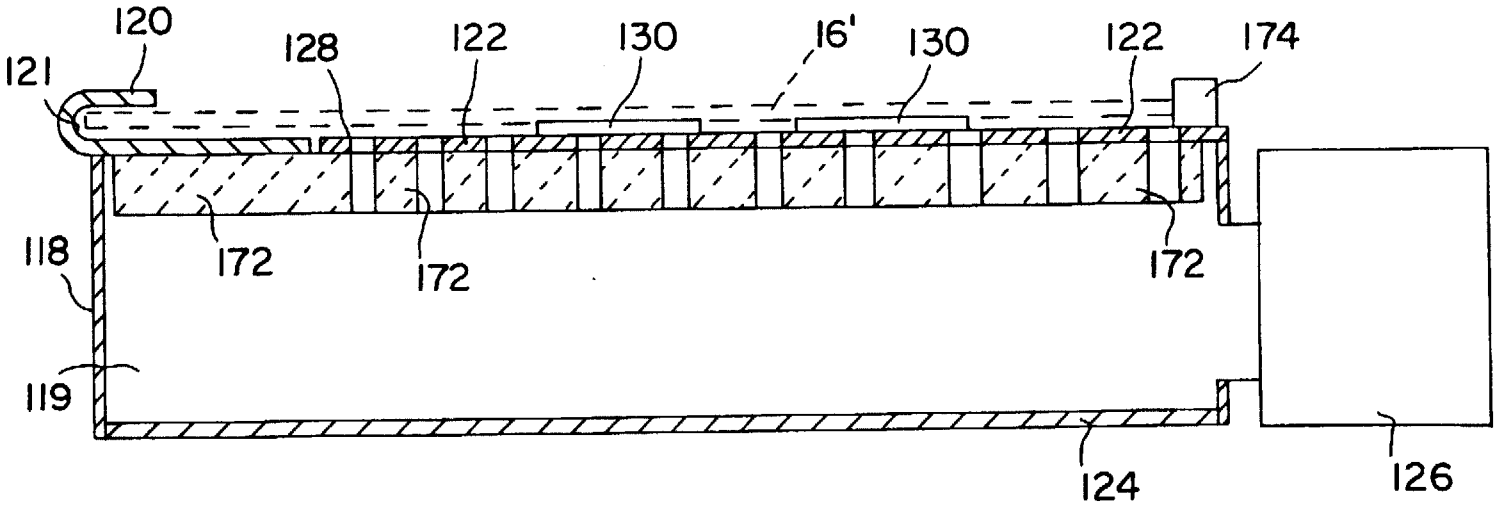
FIG. 8 is a partial view, partly in cross section and partly in phantom, of the sheet aligner of FIG. 7.

Referring to FIGS. 6–8, in an alternative embodiment, the accent color printer 10' can add color indicia to separate individual documents 16'. The accent color printer 10' employs an alternative in-feed system 18' and a different outfeed system 98' when compared to the above-discussed embodiment. Individual documents 16' are received from an input control 12'. Input control 12' can comprise a document stacker or other document handler. The in-feed system 18' serves to align the individual documents 16' and place them on the vacuum belt conveyor 32. The individual documents 16' enter the input control 18' and are captured between an input roller 110 and an input belt 112 supported on belt rollers 114, 116. The input roller 110 and input belt 112 serve to redirect the individual documents 16' from a generally horizontal path to a generally vertical path.

The vertically oriented individual documents 16' from the input roller 110 are moved across the deck surface 128 of a sheet aligner 118. As may best be seen from FIG. 8, the sheet aligner 118 has an edge guide 120 located adjacent the deck surface 128 for aligning the individual documents 16'. The edge guide 120 is a formed sheet metal guide having a C- or J-shaped cross section. The deck surface 128 of the sheet aligner 118 is defined by a perforated metal platen 122. A housing 124 defines a vacuum chamber 119 beneath the platen 122. A fan 126 evacuates air from vacuum chamber 119 such that a pressure differential is created between the vacuum chamber 119 and the outside air pressure. Therefore, when an individual document 16' travels across the deck surface 128 of the sheet aligner 118, the individual sheet 16' is forced onto to the sheet aligner 118.

The sheet aligner 118 further comprises a set of skewed aligner belts 130. (See FIG. 7.) The aligner belts 130 are driven on aligner belt rollers 132, 134. The aligner belts 130 are oriented at an angle B from the direction of the paper path. The angle B for the aligner belts 130 has, in one reduction to practice, been found to be preferably approximately 5° with respect to the paper path direction. The aligner belts 130 are further positioned to slide on the deck surface 128. The aligner belt rollers 134 and input roller 110 may be driven by a single motor 138. The motor 138 drives input roller 110 via drive belt 140 and input roller 110 drives aligner rollers 134 via a drive belt 136.

Individual documents 16' entering the sheet aligner 118 would free fall if no other force was placed upon them. However, the pressure differential created by the fan 126, evacuating the air from the vacuum chamber 119, supports the individual documents 16' against the deck surface 128. Due to the angle B of the moving aligner belts 130, the driving force on the individual documents 16' is toward the edge guide 120. The angled force of the drive belts 130 relative to the paper path thus edge registers the individual documents 16' against the edge guide 120. After the individual documents 16' register against the inner surface 121 of the edge guide 120, the aligner belts 130 slip relative to the document as the document 16' continues to move on a path defined by the edge guide 120.

The aligner belts 130 are preferably overdriven with respect to the speed of the documents 16' in the paper path. In one reduction to practice, the aligner belts 130 were overdriven approximately 30 percent for reliable aligning results.

A balance of force is required to properly align the document 16'. Insufficient vacuum permits free fall of the document 16' and therefore inadequate alignment. Excess friction between the aligner belts 130 and the individual documents 16' caused by an excessive pressure differential can result in a large driving force against the edge guide 120 and therefore may force the document 16' to climb up the edge guide 120 and produce misalignment.

The sheet aligner 118 of the invention is unaffected by paper thickness. The sheet aligner 118 provides the vertical orientation for the documents 16' by use of a pressure differential acting against the aligner deck 128. A pressure differential is preferred because a vacuum force does not require particular tuning of the sheet aligner 118 for varying paper thicknesses.

Individual documents 16' aligned by the sheet aligner 118 are placed onto the vacuum belt 50 by a document placement system 142. The document placement system 142 comprises a placement belt 144 moving on placement rollers 146, 148, 150. The documents 16' from the sheet aligner 118 are captured between the placement belt 144 and the vacuum belt 50 as the vacuum belt 50 rolls around the lower belt drum 36.

The documents 16' are printed with color-indicia in the same manner as the continuous form 16. However, for the individual documents 16', the position readers 92 consist of two retroreflective photosensors at a fixed distance from each other in the paper path direction. The position readers 92 and 93 optically sense the leading edge of each individual document 16'. The print controller 95 employs the signals of the encoder 90 and readers 92, 93 in the same manner as for continuous form 16 to determine document position for printing the color indicia by the printhead systems 60.

The documents 16' are withdrawn from the vacuum belt 50 by an outfeed system 98'. Individual documents 16' containing color indicia are carried toward the upper portion of the vacuum belt conveyor 32 on the transport surface 51. The vacuum belt 50 is accelerated away from the individual sheets 16' as the vacuum belt 50 approaches the upper belt drum 38. This acceleration is due to the sudden difference in curvature of belt 50 as it departs from the arc shaped tension side sliding bed 44 and passes about the upper belt drum 38.

The individual sheets 16' which separate from belt 50 continue on a generally straight path toward the top of the cabinet 24 as the vacuum belt 50 accelerates around the upper belt drum 38. This separation, in part, is due to a drop in the pressure differential at the upper portion of the vacuum belt conveyor 32. The leading edges of the individual documents 16' are caught by an upper outfeed conveyor belt 152 and captured between the upper outfeed conveyor belt 152 and a lower outfeed conveyor belt 154.

The upper outfeed conveyor belt 152 moves on rollers 156, 158, 160 and the lower outfeed conveyor belt 154 moves on rollers 162, 164, 166, 168. Roller 160 is driven to move the upper outfeed conveyor belt, and the contact with the upper outfeed conveyor belt 152 drives the lower outfeed conveyor belt 154. Individual documents 16' captured between the upper and lower outfeed conveyor belts 152, 154 are transported from the upper portion of the vacuum belt conveyor 32 to an outfeed position 170. The outfeed belts are driven at a linear velocity which is slightly greater than the speed of the vacuum belt 50 to aid in picking documents 16' off the transport surface 51. From the outfeed position 170, the documents 16' are collected for further processing.

For documents 16' comprising relatively heavy paper, stripper fingers (not shown) may be required to assist in directing the individual documents into the outfeed system 98'. Alternately, the roller 156 for the upper outfeed conveyor belt 152 can be moved laterally in the direction of slack side sliding bed of the vacuum belt conveyor 32 in order to engage the leading edge of a document 16' in a position further around the upper belt drum 38.

Individual documents 16' also require heating of the paper to obtain optimal print quality with the wax based ink employed by the print heads 65. Heating of the incoming individual documents 16' is generally more difficult than for documents on a continuous form 16 because of decreased residence time of the individual documents 16' in the printer 10' before printing occurs. To raise paper temperature, the aligner deck platen 122 is provided with an attached heater 172 and heats the individual documents in a manner similar to the heated roller 30 heating the continuous form 16. The heater 172 preferably provides 10 watts per square inch of heating capacity and a total heating capability of approximately 1600 watts. The heater 172 is perforated in the same pattern as the platen 122 in order to permit air flow from the deck surface 128. The heater 172 is controlled in response to a platen temperature sensor 174.

In order to further decrease the heating time required, heated air from the vacuum box 124 is directed from the fan 126 toward the incoming documents 16'. Ducting 216 directs heated air from the fan 126 to the top portion of the sheet aligner 118. The air is directed over an air heater 218 for additional heating and then down across the incoming documents 16'. The heated air is then drawn back into the vacuum box 124 through the platen 122 and the attached heater 172. This closed loop recirculation of the same heated air generally reduces the energy requirements of the heaters 174, 218 and increases air temperature to permit a decreased heating time requirement for a document to be heated to a given temperature. The air heater 218 is regulated in response to an air temperature sensor 176. For optimum paper heating, the air temperature over the individual document should be maintained approximately 5° higher than the platen temperature for even heating. For the accent color printer 10', the ambient temperature of the cabinet is increased by cabinet heaters 70 located in the lower portion of the cabinet 24 and by the internal heaters 74. Both heaters 70, 74 are regulated in response to the cabinet temperature sensor 86.

While preferred embodiments of the foregoing invention have been set forth for purposes of illustration, the foregoing description should not be deemed a limitation of the invention described herein. Accordingly, various modifications, adaptations and alternatives may occur to one skilled in the art without departing from the spirit and the scope of the present invention.

We claim:

1. A printer for producing color indicia on documents, said printer comprising:

in-feed means for receiving a document to be printed;

means defining a curvilinear surface against which documents are supported during printing;

conveyor means for moving received documents over said curvilinear surface, said conveyor means defining a document transport path;

means establishing a pressure differential for holding documents on said conveyor means during movement thereof over said curvilinear surface;

printing means juxtapositioned to said curvilinear surface, said printing means defining a printing zone and comprising plural print heads having ink jets for printing color indicia with wax based ink, said ink jets facing said curvilinear surface whereby ink may be selectively applied to documents moving through said printing zone on said document transport path;

means for transferring received documents from said in-feed means to said conveyor means, said document transferring means including means for heating received documents before delivery thereof to said conveyor means; and means for controlling the temperature of documents moving along said document transport path to insure that the document temperature is within a predetermined range during movement thereof through said printing zone.

2. The printer of claim 1 further comprising:

aligner means for edge justifying documents received by said in-feed means.

3. The printer of claim 2 wherein said aligner means comprises:

platen means for defining a document support surface;

edge guide means for defining a linear justifying edge, said edge guide means being juxtapositioned to said platen means and at least in part extending generally transversely with respect to said support surface;

belt means for moving documents relative to said platen means, said belt means comprising at least a first movable belt which passes over said support surface, said belt means comprising at least a first movable belt oriented at an angle relative to said justifying edge, documents to be edge justified travelling over said support surface on said belt means; and means for establishing a pressure differential across documents located in registration with said platen means and moving with said belt means, said pressure differential urging the documents in the direction of said support surface but being insufficient to prevent document movement with said belt means whereby the documents will be carried by belt means into contact with said justifying edge and subsequently moved along said justifying edge.

4. The printer of claim 1 further comprising:

means for detecting relative motion between documents moving over said curvilinear surface and said conveyor means.

5. The printer of claim 4 wherein said conveyor means defines a moving transport surface and said relative motion detecting means comprises:

encoder means for generating a first signal commensurate with the velocity of said conveyor means transport surface;

first sensor means for generating a second signal when a document reaches a first position on said document transport path;

second sensor means for generating a third signal when said document reaches a second position on said document transport path, said second position being a predetermined distance from said first position;

means responsive to said second and third signals for generating a signal commensurate with the velocity of said document;

means for comparing said signals commensurate with conveyor transport surface velocity and document velocity and generating an error signal when the document velocity differs from the transport surface velocity by a predetermined amount, said error signal being indicative of relative motion between the document and the conveyor transport surface; and means responsive to said error signal for controlling the timing of the energization of said print heads.

6. The printer of claim 1 wherein the documents to be printed are serially interconnected to form a web and wherein said in-feed means comprises:

means for tensioning a received web.

7. The printer of claim 6 wherein said tensioning means comprises:

a first roller, the received web passing over said first roller and contacting a first surface thereof;

means for capturing the web, said capturing means urging the web against said first surface of said first roller, the web passing between said first roller and said capturing means;

means for exerting a pulling force on the web at a point downstream, in the direction of web advancement, from said first roller; and means for imposing a retarding force on the web in opposition to said pulling force, said retarding force imposing means comprising hysteresis clutch means coupled to said roller, said clutch means resisting rotation of said roller in response to said pulling force whereby a preestablished tension is imparted to the web.

8. The printer of claim 1 further comprising:

out-feed means for removing documents from said conveyor means.

9. The printer of claim 8 wherein said conveyor means comprises:

a flexible belt conveyor, said belt conveyor following an arcuate path having a radius which is much smaller than the radius of said curvilinear surface at one end of said curvilinear surface whereby a support surface for a transported document will suddenly move away from the document leaving the leading edge thereof unsupported; and wherein said out-feed means comprises:

means for engaging the unsupported leading edge of a document and transporting the thus engaged document on a printer document discharge path.

10. The printer of claim 1 further comprising:

ink jet cleaning means for purging and cleaning said print head ink jets.

11. The printer of claim 10 wherein said cleaning means comprises:

a roller associated with each of said print heads, said rollers each having a roller surface and defining an axis of rotation, said rollers being rotatable in a single direction about said axes of rotation; and means for reciprocally driving said print heads along parallel paths angularly related to said document transport path from first positions displaced from associated of said rollers to second positions where said ink jets are in sealing contact with a said roller surface, said rollers being caused to at least partially rotate from ink jet contact, said driving means further moving said print heads to a third position displaced from said associated rollers, said driving means further moving said print heads past said roller surfaces in a direction which is opposite to said initial motion direction whereby said ink jets are wiped by said roller surfaces and said rollers do not rotate.

12. The printer of claim 1 wherein said printer further comprises a housing defining a closed cabinet and wherein said transferring means heating means comprises:

cabinet heaters for raising the ambient temperature of the air in said cabinet; and contact heater means for contacting and heating said documents prior to printing; and wherein said temperature controlling means comprises:

non-contacting heater means for heating documents moving on said belt.

13. The printer of claim 6 wherein said printer further comprises a housing defining a closed cabinet and wherein said transferring means heating means comprises:

cabinet heaters for raising the ambient temperature of the air in said cabinet; and contact heater means for contacting and heating said documents prior to printing; and wherein said temperature controlling means comprises:

non-contacting heater means for heating documents moving on said belt.

14. The printer of claim 13 further comprising:

ink jet cleaning means for purging and cleaning said print head ink jets.

15. The printer of claim 13 wherein said tensioning means comprises:

a first roller, the received web passing over said first roller and contacting a first surface thereof;

means for capturing the web, said capturing means urging the web against said first surface of said first roller, the web passing between said first roller and said capturing means;

means for exerting a pulling force on the web at a point downstream, in the direction of web advancement, from said first roller; and means for imposing a retarding force on the web in opposition to said pulling force, said retarding force imposing means comprising hysteresis clutch means coupled to said roller, said clutch means resisting rotation of said roller in response to said pulling force whereby a preestablished tension is imparted to the web.

16. The printer of claim 14 wherein said tensioning means comprises:

a first roller, the received web passing over said first roller and contacting a first surface thereof;

means for capturing the web, said capturing means urging the web against said first surface of said first roller, the web passing between said first roller and said capturing means;

means for exerting a pulling force on the web at a point downstream, in the direction of web advancement, from said first roller; and means for imposing a retarding force on the web in opposition to said pulling force, said retarding force imposing means comprising hysteresis clutch means coupled to said roller, said clutch means resisting rotation of said roller in response to said pulling force whereby a preestablished tension is imparted to the web.

17. The printer of claim 16 wherein said cleaning means comprises:

a roller associated with each of said print heads, said rollers each having a roller surface and defining an axis of rotation, said rollers being rotatable in a single direction about said axes of rotation; and means for reciprocally driving said print heads from first positions displaced from associated of said rollers to second positions where said ink jets are in sealing contact with a said roller surface, said rollers being caused to at least partially rotate from ink jet contact, said driving means further moving said print heads to a third position displaced from said associated rollers, said driving means further moving said print heads past said roller surfaces in a direction which is opposite to said initial motion direction whereby said ink jets are wiped by said roller surfaces and said rollers do not rotate.

18. The printer of claim 12 further comprising:

aligner means for edge justifying documents received by said in-feed means.

19. The printer of claim 12 further comprising:

means for detecting relative motion between documents moving over said curvilinear surface and said conveyor means.

20. The printer of claim 12 further comprising:

out-feed means for removing documents from said conveyor means.

21. The printer of claim 18 further comprising:

means for detecting relative motion between documents moving over said curvilinear surface and said conveyor means.

22. The printer of claim 21 wherein said conveyor means defines a moving transport surface and said relative motion detecting means comprises:

encoder means for generating a first signal commensurate with the velocity of said conveyor means transport surface;

first sensor means for generating a second signal when a document reaches a first position on said document transport path;

second sensor means for generating a third signal when said document reaches a second position on said document transport path, said second position being a determined distance from said first position;

means responsive to said second and third signals for generating a signal commensurate with the velocity of said document;

means for comparing said signals commensurate with conveyor transport surface velocity and document velocity and generating an error signal when the document velocity differs from the transport surface velocity by a predetermined amount, said error signal being indicative of relative motion between the document and the conveyor transport surface; and means responsive to said error signal for controlling the timing of the energization of said print heads.

23. The printer of claim 22 further comprising:

out-feed means for removing documents from said conveyor means.

24. The printer of claim 23 wherein said conveyor means comprises:

a flexible belt conveyor, said belt conveyor following an arcuate path having a radius which is much smaller than the radius of said curvilinear surface at one end of said curvilinear surface whereby a support surface for a transported document will suddenly move away from the document leaving the leading edge thereof unsupported; and wherein said out-feed means comprises:

means for engaging the unsupported leading edge of a document and transporting the thus engaged document on a printed document discharge path.

25. The printer of claim 18 further comprising:

ink jet cleaning means for purging and cleaning said print head ink jets.

26. The printer of claim 24 further comprising:

ink jet cleaning means for purging and cleaning said print head ink jets.

27. The printer of claim 26 wherein said cleaning means comprises:

a roller associated with each of said print heads, said rollers each having a roller surface and defining an axis of rotation, said rollers being rotatable in a single direction about said axes of rotation; and means for reciprocally driving said print heads along parallel paths angularly related to said document transport path from first positions displaced from associated of said rollers to second positions where said ink jets are in sealing contact with a said roller surface, said rollers being caused to at least partially rotate from ink jet contact, said driving means further moving said print heads to a third position displaced from said associated rollers, said driving means further moving said print heads past said roller surfaces in a direction which is opposite to said initial motion direction whereby said ink jets are wiped by said roller surfaces and said rollers do not rotate.

28. An aligner for edge justifying a moving document, said aligner comprising:

platen means for defining a document support surface;

edge guide means for defining a linear justifying edge, said edge guide means being juxtapositioned to said platen means and at least in part extending generally transversely with respect to said support surface;

belt means for moving documents relative to said platen means, said belt means comprising at least a first movable belt which passes over said support surface, said belt means comprising at least a first movable belt oriented at an angle relative to said justifying edge, documents to be edge justified travelling over said support surface on said belt means; and means for establishing a pressure differential across documents located in registration with said platen means and moving with said belt means, said pressure differential urging the documents in the direction of said support surface but being insufficient to prevent document movement with said belt means whereby the documents will be carried by belt means into contact with said justifying edge and subsequently moved along said justifying edge.

29. The sheet aligner of claim 28 wherein said edge guide means is U-shaped.

30. The sheet aligner of claim 28 wherein said platen means comprises a perforated deck.

31. The sheet aligner of claim 30 wherein said pressure means comprises a housing defining a vacuum chamber, said vacuum chamber being fluidly connected to a first side of said platen means, and a fan for evacuating air from said vacuum chamber where air will flow through said platen means deck.

32. The sheet aligner of claim 28 further comprising heater means in contact with said platen means, said heater means for heating said platen.

33. The sheet aligner of claim 28 wherein said belt is oriented at an angle of approximately 5° with respect to said justifying edge.

34. The sheet aligner of claim 31 further comprises ducting means for ducting air from said fan over said document support surface.

35. The sheet aligner of claim 34 wherein said ducting further comprises heating means for heating air passing through said ducting means.

36. Apparatus for detecting relative motion between a document disposed on a printer conveyor having a moving transport surface and the conveyor transport surface, said apparatus comprising:

encoder means for generating a first signal commensurate with the velocity of the conveyor transport surface;

first detector means for generating a second signal when a document reaches a first position on the transport path defined by the printer conveyor;

second detector means for generating a third signal when the said document reaches a second position on the transport path, said second position being a predetermined distance from said first position;

means responsive to said second and third signals for generating a signal commensurate with document velocity; and printer controller means for comparing said signals commensurate with transport surface and document velocity and generating an error signal when the document velocity is less than the transport surface velocity by a predetermined magnitude, said error signal being indicative of relative motion between the document and the conveyor transport surface.

37. The apparatus of claim 36 wherein said first signal is a series of pulses.

38. The apparatus of claim 36 wherein said printer controller means further comprises means for adjusting said first signal in response to said error signal.

39. The apparatus of claim 38 wherein said first signal is a plurality of pulses and said adjustment means deletes pulses in response to said error signals.

40. Apparatus for tensioning a continuous web material on which indicia is to be printed, said apparatus comprising:

a first roller, the web of material passing over said first roller and contacting a first surface thereof;

means for capturing the type of material, said capturing means urging the web against said surface of said first roller, the web passing between said first roller and said capturing means;

means for exerting a pulling force on the web at a point downstream, in the direction of web advancement, from said first roller; and means for imposing a retarding force to the web in opposition to said pulling force, said retarding force imposing means comprising hysteresis clutch means coupled to said roller, said clutch means resisting rotation of said roller in response to said pulling force whereby a preestablished tension is imparted to the web.

41. The tensioning apparatus of claim 40 wherein said capturing means comprises at least a first pinch roller.

42. The tensioning apparatus of claim 40 further comprising a second roller and wherein said web defines an S-shaped paper path around said first roller and said second roller.

43. An ink jet cleaning system for cleaning a printhead having a plurality of ink jets, said cleaning system comprising:

a roller associated with each of said print heads, said rollers each having a roller surface and defining an axis of rotation, said rollers being rotatable in a single direction about said axes of rotation; and means for reciprocally driving said print heads along parallel paths angularly related to said document transport path from first positions displaced from associated of said rollers to second positions where said ink jets are in sealing contact with a said roller surface, said rollers being caused to at least partially rotate from ink jet contact, said driving means further moving said print heads to a third position displaced from said associated rollers, said driving means further moving said print heads past said roller surfaces in a direction which is opposite to said initial motion direction whereby said ink jets are wiped by said roller surfaces and said rollers do not rotate.

44. The ink jet cleaning system of claim 43 wherein said roller surface is defined by a synthetic material having a durometer rating of approximately 40 shore A.

45. The ink jet cleaning system of claim 43 further comprising:

a blade in contact with said roller surface for removing wax from said roller surface.

46. The ink jet cleaning system of claim 43 wherein said driving means comprises a motor and an actuator screw, the print head being supported from said screw.

47. The ink jet cleaning system of claim 46 wherein said driving means moves said ink jet along a linear path.

48. Apparatus for separating documents from an arcuate transport path defined by a flexible belt conveyor, the transport path having a first radius of curvature, said apparatus comprising:

means causing the belt conveyor to follow an arcuate path having a second radius of curvature which is much smaller than said first radius of curvature whereby a support surface for transported documents will suddenly move away from the document leaving the leading edge thereof unsupported; and means for engaging the unsupported leading edge of a document and transporting the thus engaged document on a new transport path.

49. The apparatus of claim 48 wherein the belt conveyor is a vacuum conveyor which establishes a pressure differential across documents being transported and wherein said apparatus further comprises:

means for decreasing the pressure differential across the documents immediately upstream of said means for causing the belt conveyor to follow the arcuate path of second radius.

50. A method for printing color indicia on a preprinted document, said method comprising the steps of:

heating said document to a temperature within a preestablished range;

positioning said document on an curvilinear shaped surface;

moving said document over said curvilinear shaped surface in a paper path direction;

determining the velocity of said document;

printing color indicia on said document with a wax based ink at a rate commensurate with said document velocity; and removing said document from said transport surface.

51. The method of claim 50 further comprising the steps of:

monitoring the temperature of the document; and maintaining the document temperature within the preestablished range.

52. A heating apparatus for heating a document prior to printing in a printer, said printer having a cabinet and a conveyor in said cabinet, said conveyor having a belt for moving said documents past print heads using a wax based ink for printing, said heating apparatus comprising:

cabinet heaters for raising the ambient temperature of air in said printer;

heated surface means for contacting said document prior to said printing; and conveyor heater means for heating said belt.

53. The heating apparatus of claim 52 further comprising:

temperature sensing means for sensing document temperature prior to printing; and adjusting means for adjusting at least one of said cabinet heaters, heated surface means, and conveyor heater means in response to said sensed temperature.

* * * * *